United States Patent [19]

Saito et al.

[11] Patent Number: 4,627,404

[45] Date of Patent: Dec. 9, 1986

[54] METHOD AND APPARATUS FOR CONTROLLING AIR-FUEL RATIO IN INTERNAL COMBUSTION ENGINE

[75] Inventors: Kimitaka Saito, Okazaki; Tokio Kohama, Nishio; Tsuneyuki Egami, Nukata; Tsutomu Saito, Okazaki; Hiroshi Takahashi, Toyota; Kunihiko Sato, Okazaki, all of Japan

[73] Assignees: Nippon Soken, Inc., Nishio; Toyota Jidosha Kabushiki Kaisha, Toyota, both of Japan

[21] Appl. No.: 675,704

[22] Filed: Nov. 28, 1984

[30] Foreign Application Priority Data

Nov. 29, 1983 [JP] Japan ..... 58-223196

[51] Int. Cl.[4] ..... F02B 33/00

[52] U.S. Cl. ..... 123/492; 123/440

[58] Field of Search ..... 123/492, 493, 440, 489

[56] References Cited

U.S. PATENT DOCUMENTS

| | | | |
|---|---|---|---|
| 4,075,982 | 2/1978 | Asano et al. | 123/440 |
| 4,109,615 | 8/1978 | Asano | 123/440 |
| 4,130,095 | 12/1978 | Bowler et al. | 123/440 |
| 4,235,204 | 11/1980 | Rice | 123/440 |
| 4,270,503 | 6/1981 | Pomerantz | 123/440 |
| 4,355,616 | 10/1982 | Tamura et al. | 123/440 |
| 4,359,983 | 11/1982 | Carlson et al. | 123/440 |
| 4,437,446 | 3/1984 | Isomura | 123/492 |
| 4,463,731 | 8/1984 | Matsuoka | 123/492 |
| 4,499,882 | 2/1985 | Saito | 123/492 |
| 4,513,722 | 4/1985 | Hasegawa | 123/492 |

FOREIGN PATENT DOCUMENTS

| | | | |
|---|---|---|---|
| 58-133434 | 8/1983 | Japan | 123/492 |
| 58-133435 | 8/1983 | Japan | 123/492 |

*Primary Examiner*—Ronald B. Cox

*Attorney, Agent, or Firm*—Cushman, Darby & Cushman

[57] ABSTRACT

In an internal combustion engine, a base fuel amount is calculated, and an air-fuel ratio deviation for each region is determined by a predetermined engine operating parameter when the engine is in a transient state such as an acceleration state or a deceleration state. A transient fuel correction amount is calculated in accordance with the calculated air-fuel ratio deviation for each region determined by the predetermined engine operating parameter. A fuel amount to be supplied to the engine is calculated by correcting said base fuel amount in accordance with the transient fuel correction amount.

31 Claims, 24 Drawing Figures

10
AIRFLOW METER
2
COOLANT TEMP. SENSOR
4
AIR-FUEL RATIO SENSOR
6
THROTTLE OPENING SENSOR
91
ENGINE ROTATIONAL SPEED SENSOR
3
MPX
101
A/D
102
WAVE-SHAPING CIRCUIT
103
INPUT PORT
104
INPUT COUNTER
105
106
ROM
107
CPU
108
RAM
109
OUTPUT COUNTER
110
POWER DRIVING CIRCUIT
111
FUEL INJECTION VALVE
8

METHOD AND APPARATUS FOR CONTROLLING AIR-FUEL RATIO IN INTERNAL COMBUSTION ENGINE

BACKGROUND OF THE INVENTION

1. Field of the Invention

The present invention relates to a method and apparatus for controlling the air-fuel ratio in an internal combustion engine.

2. Description of the Related Art

One prior art apparatus for controlling the air-fuel ratio in an internal combustion engine includes means for calculating a base fuel amount signal during a steady state of the engine in correspondence with values of predetermined engine operation parameters, including engine coolant temperature; means for detecting a transient operation state of the engine representing output power increase demand; means, responsive to the detected engine temperature and the detected transient state of the engine, for generating a reinforce promotion signal which has an initial value determined by the detected transient state of the engine and which is increased by a factor changing toward unity at a rate decided by the detected engine temperature; and means for supplying fuel to the engine in accordance with the base fuel amount signal and the reinforce promotion signal to supply the engine with fuel. This type of apparatus enables a fuel supply system with a constantly optimum air-fuel ratio not only in a steady state but also in a transient state of the engine and thus enables a constantly optimal engine operation. Such an apparatus is disclosed, for example, in Japanese Unexamined Patent Publication (Kokai) No. 56-6034.

In the above-mentioned type of apparatus, however, no consideration is given to long-term changes in the operating characteristics of the engine, for example, changes in characteristics due to deposition of a viscous material such as fine carbon particles originating from lubricant constituents and combustion products at the valve clearance or at an injection nozzle of an electronic fuel injector and changes in characteristics due to such deposition at the rear surface of each cylinder intake valve. In addition, the above-mentioned apparatus has no means for detecting a change of the air-fuel ratio during a transient state such as an acceleration mode or a deceleration mode deviated from the optimum value due to the long-term changes in the operating characteristics of the engine, changes in the gasoline characteristics, or the like. Therefore, if gasoline having low volatility characteristics is used, or if long term changes occur in the engine, the air-fuel ratio becomes lean during an acceleration mode, thereby leading to bad drivability such as non-smooth acceleration. Contrary to this, if gasoline having high volatility characteristics is used, the air-fuel ratio becomes rich during a deceleration mode, thereby increasing the fuel consumption and deteriorating the emission gas characteristics.

Clogging of injectors may be compensated for by a feedback operation by an air-fuel ratio sensor in the case of a steady state but this has not been possible in a transient state due to the absence of correction means. Also, this type of apparatus does not take into consideraton inevitable variations in and aging of the structures of the manufactured engines or airflow meters.

Further, it does not consider the problem of the seasonal difference in specific properties of the gasoline used. Usually, a gasoline producer sells different kinds of gasoline for each season of the year. These, of course, differ in volatility characteristics, as expressed by Reid vapor pressure or distillation characteristics. Even gasolines from the same producer vary from 0.5 kg/cm$^2$ to 0.86 kg/cm$^2$ in vapor pressure or from 40° C. to 58° C. in 10% recovered temperature. Such differences in volatility characteristics result in considerably different air-fuel characteristics in the transient operation state, and no consideration is given to fluctuations in the air-fuel ratio due to these changes of volatility characteristics of gasoline.

Thus, when engine operation characteristics change due to long-term deposits or when low volatility gasoline is used, the air-fuel ratio in an acceleration state becomes relatively lean. Hence, the engine operation deteriorates, e.g., non-smooth acceleration occurs. On the other hand, the air-fuel ratio in a deceleration state becomes relatively rich. Hence, emission and the specific fuel consumption deteriorate. Even when a high volatility gasoline is used, the air-fuel ratio becomes rich in an acceleration state, resulting in the same problems.

A technique for the control of the air-fuel ratio to overcome the above problems has been proposed in Japanese Patent Application No. 58-129497 (corresponding to U.S. Ser. No. 630,682), however, this still requires further improvement. According to this technique, the air-fuel ratio deviation from a reference air-fuel ratio is detected during the transient period of the internal combustion engine, and the correction amount for transient fuel injection amount correction is calculated in accordance with the detected air-fuel ratio deviation, thereby avoiding the deviation of the air-fuel ratio from the optimum value due to the deposition of viscous material on the rear surface of each cylinder intake valve, the clogging of the injectors, the aging of the engines, the airflow meters, and the like, and thus, the drivability, the fuel consumption, and the gas emission are improved.

SUMMARY OF THE INVENTION

It is an object of the present invention to provide a further improved method and apparatus for controlling the air-fuel ratio in an internal combustion engine having a higher accuracy for controlling an optimum air-fuel ratio.

According to the present invention, a transient fuel injection correction ratio is adjusted in accordance with the detected air-fuel ratio deviation for each region of an engine operating parameter such as the engine coolant temperature. For example, when a coolant temperature sensor for detecting the coolant temperature of the engine deteriorates only a specific region, such as a low temperature region, the transient correction ratio is adjusted greatly for such a low temperature region while the transient correction ratio is adjusted slightly for a high temperature region. In addition, when acceleration increased fuel amount data stored as a map in a memory such as a read-only memory (ROM) is not suitable for a specific region, the transient correction ratio is adjusted greatly for such a specific region while the correction ratio is adjusted slightly for regions other than the specific region. Further, when the affect of the air-fuel ratio for a transient state by the different gasoline characteristics is also different in correspondence to the coolant temperature, the correction ratio is adjusted greatly for a specific temperature region while the transient correction ratio is adjusted slightly for temperature regions other than the specific temperature region. As a result, the optimum air-fuel ratio during a transient state is finely controlled, thereby obtaining a further improved drivability during a transient state.

BRIEF DESCRIPTION OF THE DRAWINGS

The present invention will be more clearly understood from the description as set forth below with reference to the accompanying drawings, wherein:

FIGS. 9, 9A, and 9B are detailed flowcharts of the detection step 805 of the air-fuel ratio deviation of FIG. 8;

DESCRIPTION OF THE PREFERRED EMBODIMENT

Figure 1:
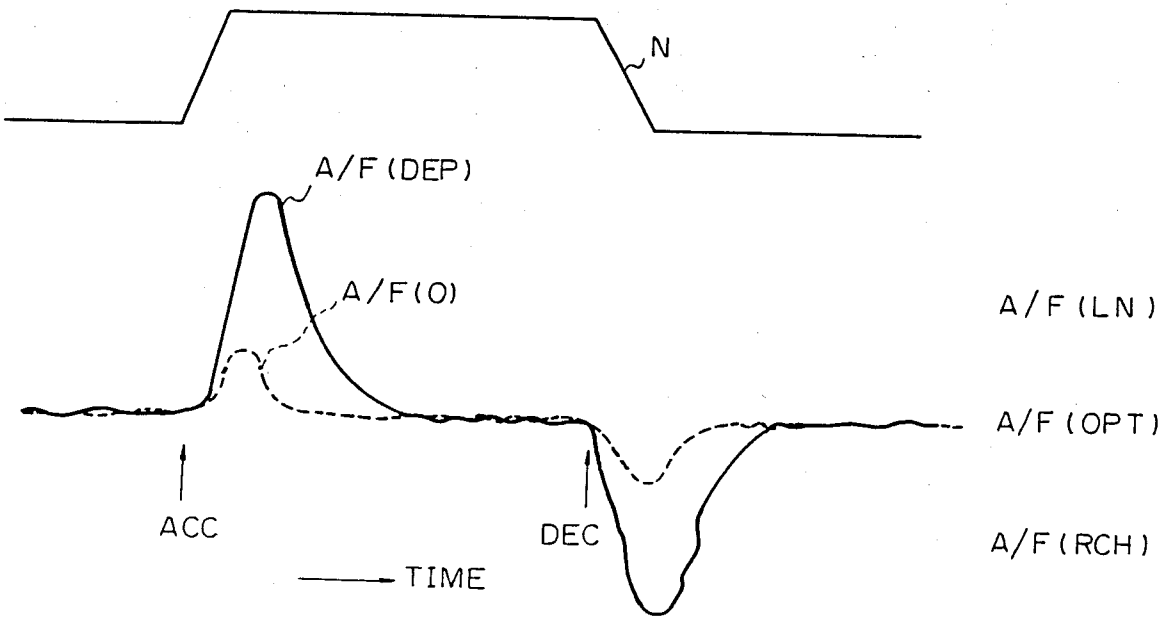
FIG. 1 is a waveform diagram illustrating the change to the air-fuel ratio in correspondence with engine acceleration and deceleration.

First, the manner of the change with time of the air-fuel ratio in an internal combustion engine under the influence of deposits will be explained with reference to FIG. 1. In FIG. 1, the waveform A/F(O) represents the change of the air-fuel ratio without deposits, while the waveform A/F(DEP) represents the change of air-fuel ratio with deposits. Acceleration timing ACC, deceleration timing DEC, optimum air-fuel ratio A/F(OPT), lean-side air-fuel ratio A/F(LN), and rich-side air-fuel ratio A/F(RCH) are indicated in FIG. 1. Note that reference N designates an engine rotational speed.

Figure 2:
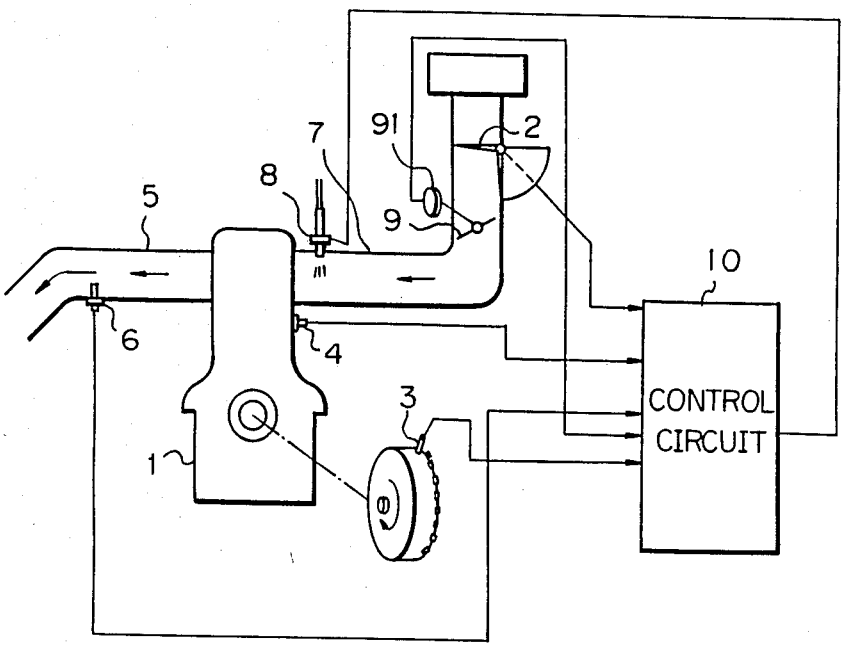
FIG. 2 is a schematic view of an internal combustion engine according to the present invention.

In FIG. 2, which illustrates an internal combustion engine according to the present invention, reference numeral 1 designates a six-cylinder spark-ignition type engine; 2 an airflow meter for detecting the air amount sucked into the engine 1; 3 a rotational speed sensor for detecting the rotational speed of the engine 1; 4 a coolant temperature sensor for detecting the coolant temperature of the engine 1; 5 an exhaust passage; 6 an air-fuel ratio sensor; 7 an air intake pipe; 8 a solenoid fuel injection valve provided at the air intake pipe 7; 9 a throttle opening valve for controlling the amount of intake air; 91 a throttle sensor for detecting the opening of the throttle opening valve 9; and 10 a control circuit for calculating the amount of the fuel to be supplied to the engine 1 and supplying the actuating signal based on the calculated amount to the fuel injection valve 8.

In a steady running state of the engine 1, the control circuit 10 calculates the base fuel injection amount on the basis of signals from the airflow meter 2, the rotational speed sensor 3, and the coolant temperature sensor 4; calculates the air-fuel ratio feedback correction value calculated on the basis of the signal from the air-fuel ratio sensor 6 to correct the base fuel amount by this correction value; and delivers the signal instructing the opening period of the fuel injection valve 8.

In the acceleration or deceleration state of the egnine 1, which is detected by the throttle opening sensor 91 or the airflow meter 2, the control circuit 10 carries out the correction of the fuel injection amount for the transient operation state.

Figure 3:
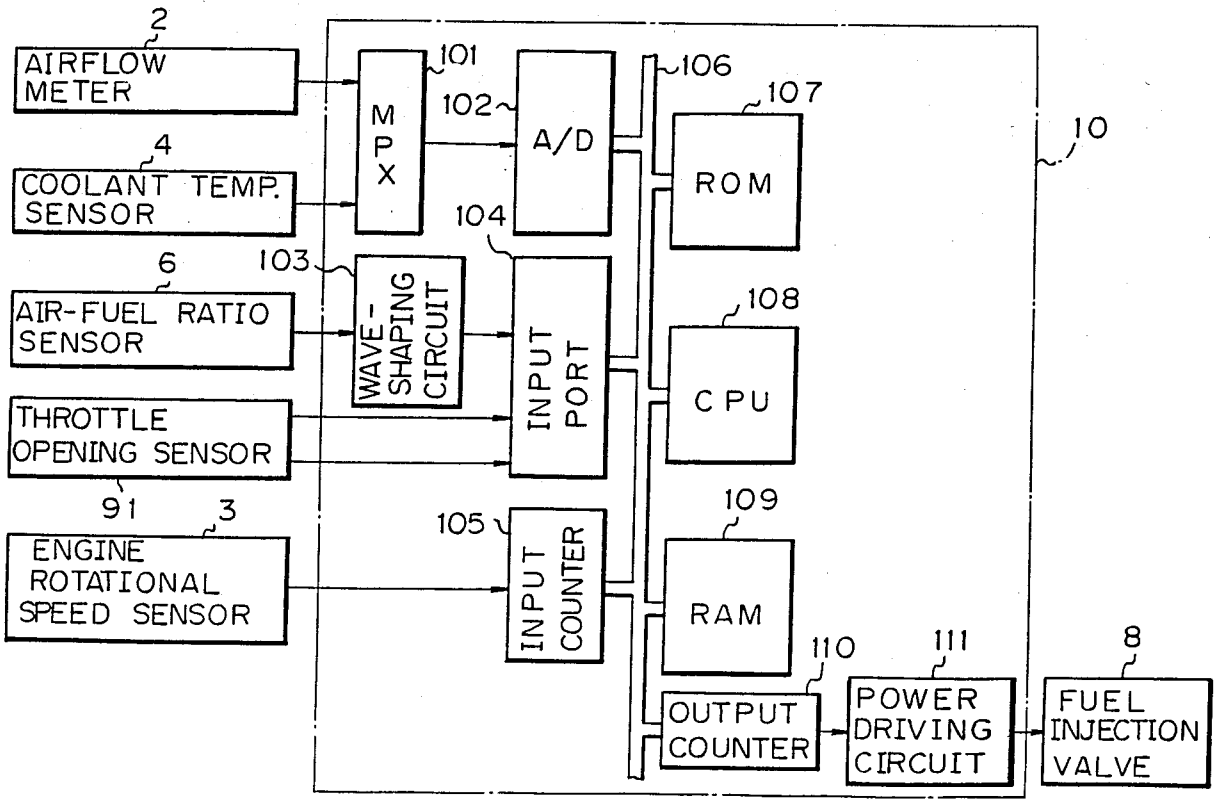
FIG. 3 is a block circuit diagram of the control circuit of FIG. 2.

In FIG. 3, which is a detailed block circuit diagram of the control circuit 10 of FIG. 2, the control circuit 10 has a multiplexer 101 for receiving signals from the airflow meter 2, and the coolant temperature sensor 4, an analog-to-digital (A/D) converter 102, a wave-shaping circuit 103 for receiving a signal from the air-fuel ratio sensor 6, an input port 104 for receiving signals from the wave-shaping circuit 103 and the throttle opening sensor 91, and an input counter 105 for receiving a signal from the engine rotational speed sensor 3. In addition, the control circuit 10 comprises a bus 106, a read-only memory (ROM) 107, a central processing unit (CPU) 108, a random-access memory (RAM) 109, an output counter 110, and a power driving circuit 111. The output signal of the power driving circuit 111 is supplied to the fuel injection valve 8.

A microcomputer of the TOYOTA TCCS type can be used for the control circuit 10. An air-fuel ratio deviation detection function and a transient fuel amount correction function are additionally provided in the control circuit 10, which will be later explained.

Figure 4:
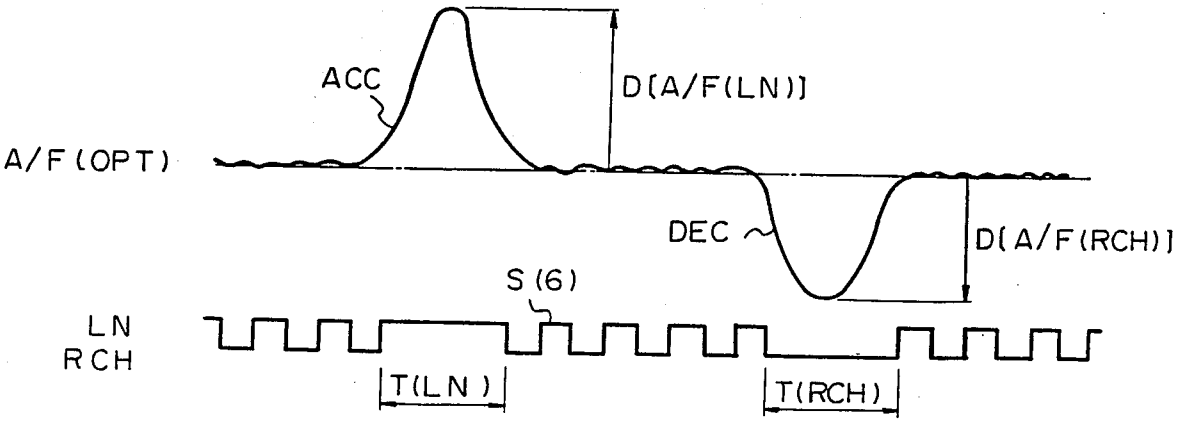
FIG. 4 is a waveform diagram illustrating the relationship between the air-fuel ratio and the output signal of the air-fuel ratio sensor during a transient state.
Figure 5:
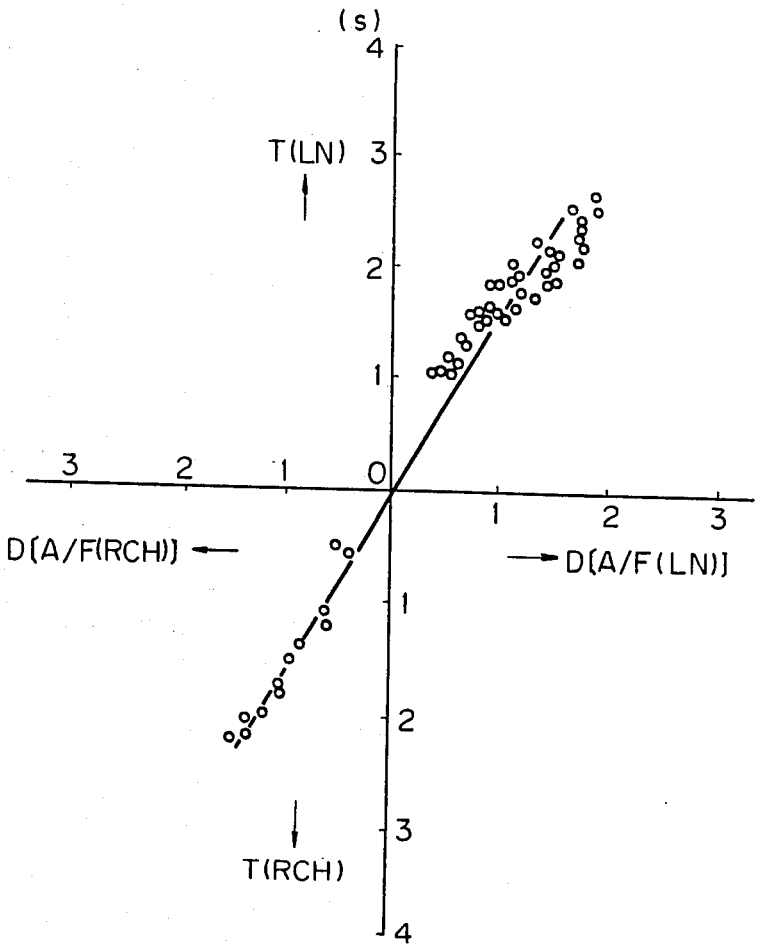
FIG. 5 is a diagram illustrating the relationship between the air-fuel ratio deviation and the duration of the rich or lean state during a transient state.

The relationship between the maximum deviations D[A/F(LN)] to the lean side and D[A/F(RCH)] to the rich side from the optimum air-fuel ratio A/F(OPT) in the acceleration or deceleration state, and also the time length T(LN) or T(RCH) of detecting the lean (T(LN)) or rich (T(RCH)) state of the mixed gas by the air-fuel ratio in the acceleration or deceleration state, are illustrated in FIGS. 4 and 5. In FIG. 4, ACC and DEC represent acceleration and deceleration, respectively, and S(6) represents the signal from the air-fuel ratio sensor 6.

Figure 6:
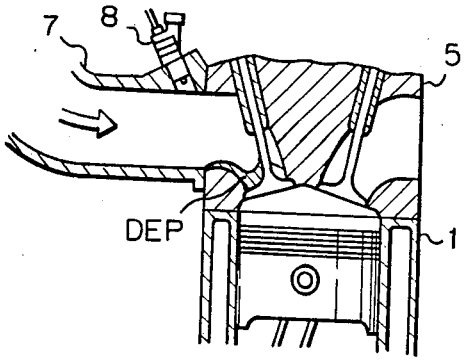
FIG. 6 is a cross-sectional view of the engine of FIG. 2 explaining the existence of deposits in the air-intake passage.
Figure 7:
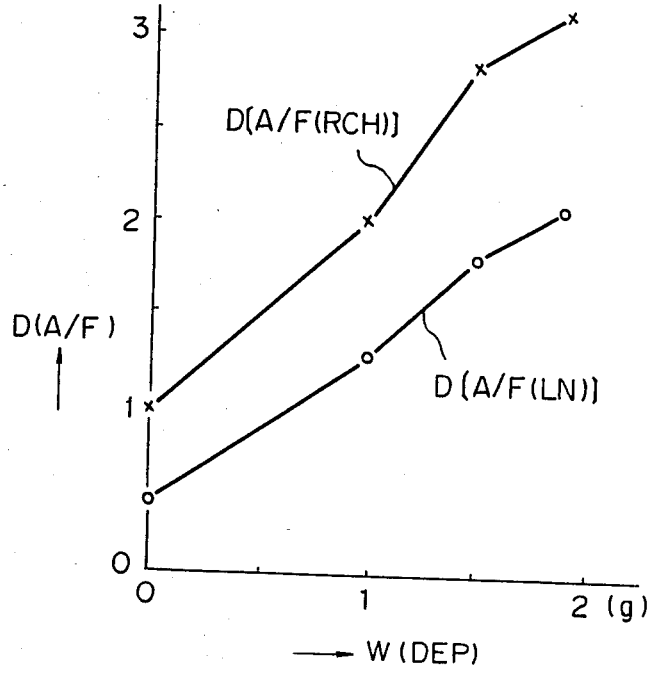
FIG. 7 is a diagram illustrating the relationship between the deposit amount in the air-intake passage and the air-fuel ratio deviation.

As an example of air-fuel ratio deviation from the optimum air-fuel ratio, the relationships between the amount W(DEP) of deposits in the air intake passage and the maximum air-fuel ratio deviations D[A/F(LN)], D[A/F(RCH)] are illustrated in FIGS. 6 and 7.

It will be understood from FIGS. 4 to 7 that the value corresponding to the deposit amount can be detected by measuring the lean-state duration TL in the state of acceleration or the rich-state duration TR in the state of deceleration. The characteristics shown in FIGS. 4 to 7 are obtained by operating an engine of the 5M-G type manufactured by Toyota Jidosha K.K.

The operation of the control circuit 10 of FIG. 2 will be explained with reference to the flowcharts of FIGS. 8, 9, and 10.

Figure 8:
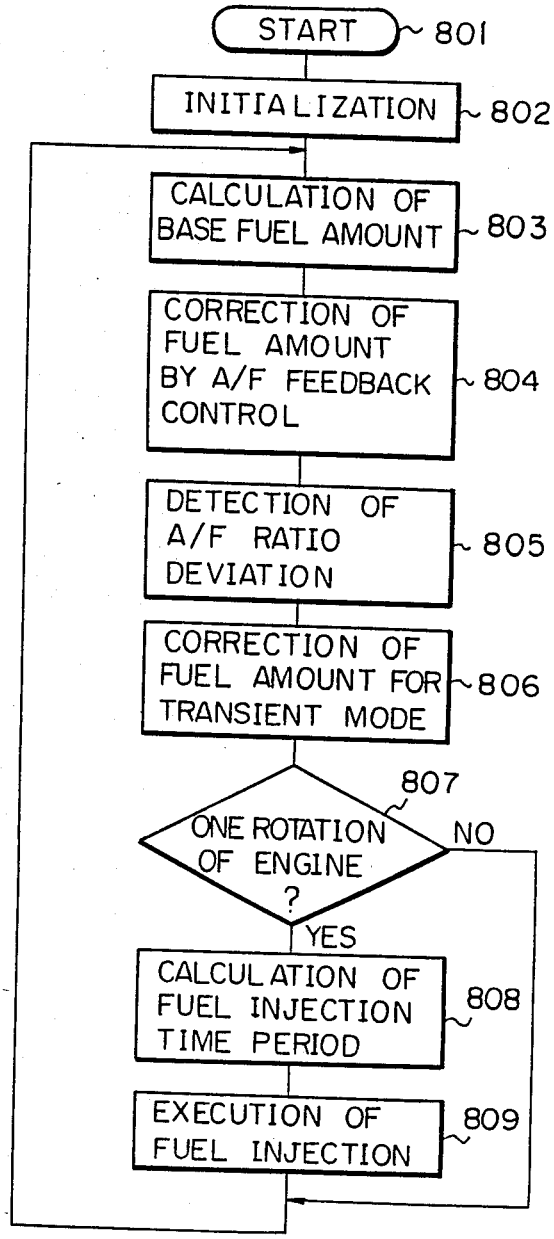
FIG. 8 is a flowchart of the operation of the control circuit of FIG. 2.

In FIG. 8, which is a main routine for carrying out electronically controlled fuel injection, the program enters into step 801 by turning on the ignition switch (not shown). At step 802, the memories, the input ports, the output ports, and the like are initialized. At step 803, a base fuel injection amount TP is calculated from data Q of the intake air amount and data N of the engine rotational speed. The amount TP is also determined by data THW of the coolant temperature. At step 804, the base fuel injection amount TP is corrected by feedback control using the signal from the air-fuel ratio sensor 6 to realize a constant air-fuel ratio. That is, the fuel injection amount T is calculated by $T \leftarrow TP \times FAF$ where FAF is an air-fuel factor.

At step 805, the detection of the air-fuel ratio deviation in the transient state is carried out. At step 806, the calculation of the transient fuel correction value f(AEW) is carried out. At step 807, it is determined whether or not one rotation of the engine 1 is detected. As a result, at every one rotation of the engine 1, the program flow advances to step 808, in which the opening period of the fuel injection valve 8 for one injection is calculated from the base fuel injection amount corrected by feedback control and the transient fuel correction ratio, that is, $T \leftarrow T\{1+f(AEW)\}$. Then, at step 809, the calculated opening period T is set in the output counter 110 (FIG. 3) thereby carrying out a fuel injection. Thus, the program flow returns to step 803. Also, if the determination at step 807 is negative, the program flow returns to step 803. The detection step 805 of the air-fuel ratio deviation is illustrated in detail in FIG. 9, and the correction step 806 of the transient fuel correction value f(AEW) for a transient state is illustrated in detail in FIG. 10.

Figure 9A:
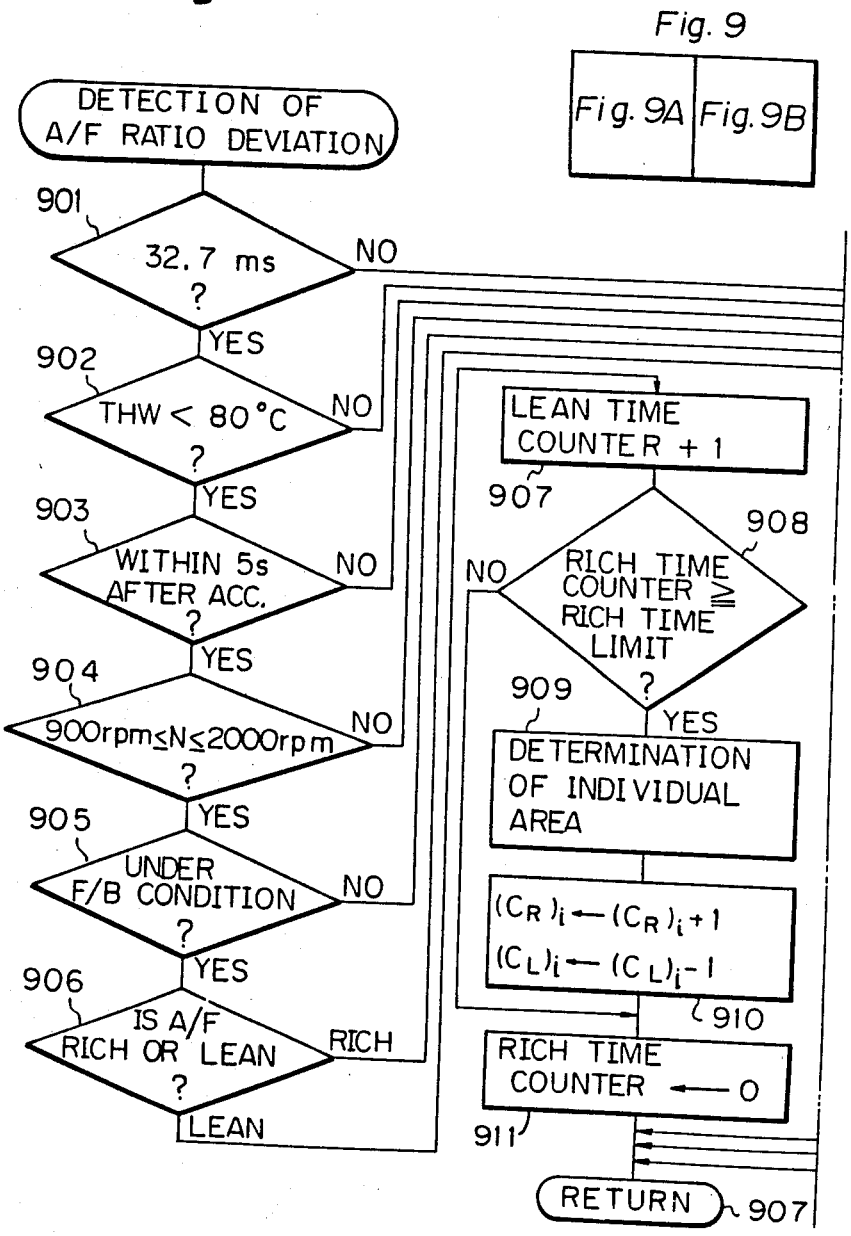
Figure 9B:
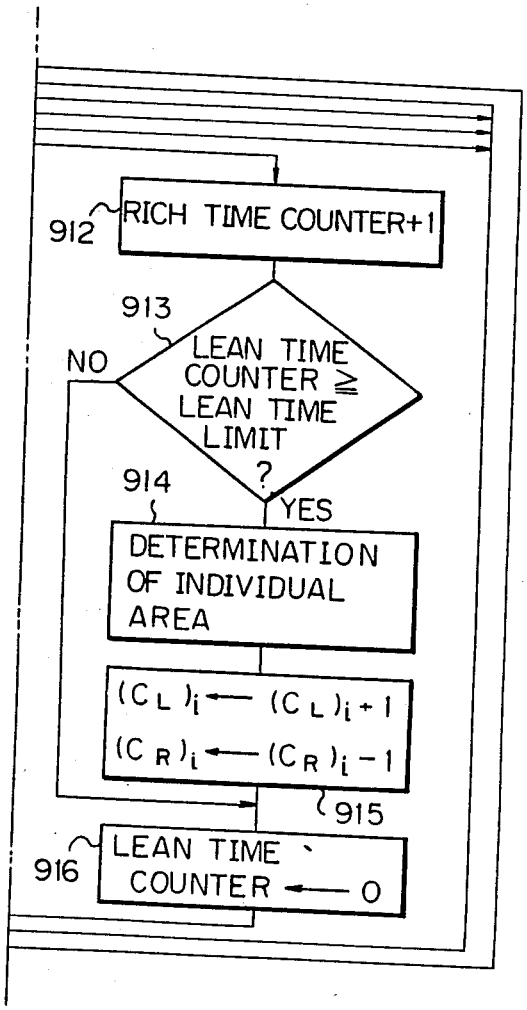
Figure 10:
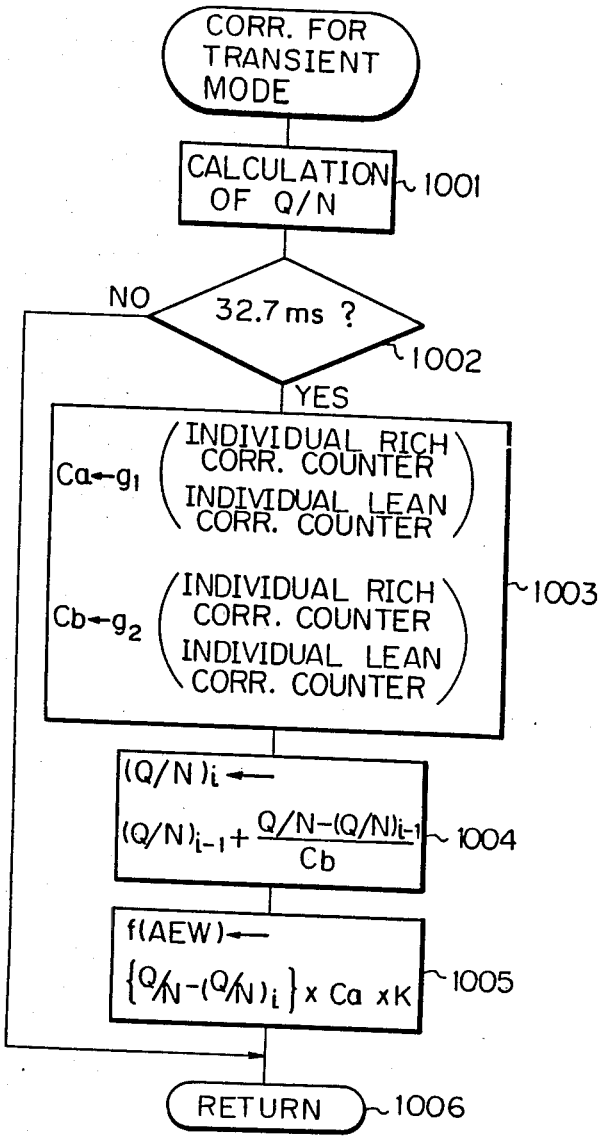
FIG. 10 is a detailed flowchart of the correction step 806 of the fuel injection amount for a transient state of FIG. 8.

Referring to FIG. 9, at step 901, it is determined whether or not a predetermined time period such as 32.7 ms is elapsed. As a result, the subsequent steps after step 902 are carried out. To detect the air-fuel ratio deviation, the voltage of the output signal of the air-fuel ratio sensor 6 is compared with a definite voltage, the two values of the air-fuel ratio in a lean state and a rich state of the mixed gas are detected, and the lean-state duration T(LN) in the acceleration state and the rich-state duration T(RCH) in the deceleration state are measured.

For example, the influence of deposits appears only when the coolant temperature is low. To facilitate the estimation of the amount of deposits at step 902, it is determined whether or not the coolant temperature is lower than a definite value such as 80° C. In addition, at step 903, it is determined whether or not a timing is within 5 seconds after acceleration, and at step 904, it is determined whether or not the rotational speed of the engine 1 is within a range of from 900 rpm to 2000 rpm. Further, at step 905, it is determined whether or not an air-fuel ratio feedback control operation is carried out. Only when all the determinations at steps 902, 903, 904, and 905 are affirmative, does the flow advance to step 906. At step 906, the determination of whether the air-fuel ratio is rich or lean is carried out. When lean, at step 907, the lean time counter is incremented by 1, thus counting T(LN) in units of 32.7 ms. Then, at step 908, the determination of whether the count of the rich time counter exceeds a predetermined rich time limit is carried out. When the determination at step 908 is affirmative at step 909, a region regarding the engine coolant temperature is determined. That is, in this case, a plurality of regions are provided for the engine coolant temperature, and one individual rich correction counter $(C_R)i$ and one individual lean correction counter $(C_L)i$ are provided for an i-th region. Then, at step 910, the individual rich correction counter allocated for the coolant temperature region determined at step 909 is counted up by 1. That is, $(C_R)i \leftarrow (C_R)i+1$. Also, in this case, $(C_L)i \leftarrow (C_L)i-1$. At step 911, the rich timer counter is cleared. On the other hand, if the determination at step 908 is negative, the program flow directly advances to step 911. Thus, the routine of FIG. 9 is completed by step 917.

Similarly, when rich at step 906, the program flow advances to step 912 in which the rich time counter is incremented by 1, thus counting T(RCH) in units of 32.7 ms. Then, at step 913, the determination of whether the count of the lean time counter exceeds a predetermined lean time limit is carried out. When the determination at step 913 is affirmative, at step 914, a region regarding the engine coolant temperature is determined. Then, at step 915, the individual lean correction counter allocated for the coolant temperature region determined at step 914 is counted up by 1. That is, $(C_L)i \leftarrow (C_L)i+1$. Also, in this case, $(C_R)i \leftarrow (C_R)i-1$. At step 916, the lean time counter is cleared. On the other hand, if the determination at step 913 is negative, the program flow directly advances to step 916.

The transient correction will be explained with reference to FIG. 10. At step 1001, the intake air amount per rotation Q/N is calculated from the intake air amount signal Q from the airflow meter 2 and the engine speed signal N from the rotational speed sensor 3. At step 1002, the determination of whether a predetermined period of, for example, 32.7 ms, has passed is carried out.

At step 1003, a correction coefficient $C_a$ and a blunting coefficient $C_b$ are obtained as functions of the count of the rich correction counter and the count of the lean correction counter. The correction coefficient $C_a$ and the blunting coefficient $C_b$ are obtained as the coefficients corresponding to the air-fuel ratio deviation in the transient state. For example, $$C_a=\{(C_L)i-(C_R)i\}\times K_a+1.0$$

$$C_b=\{(C_L)i-(C_R)i\}\times K_b+C_{b0}$$

where $K_a$, $K_b$, and $C_{bo}$ are constants.

At step 1004, $(Q/N)_i$, which is a blunted value of Q/N, is calculated by the following equation.

$$(Q/N)_i=(Q/N)_{i-1}+\{Q/N-(Q/N)_{i-1}\}/C_b$$

where $(Q/N)_{i-1}$ is given as the value of $(Q/N)_i$ at 32.7 ms before.

At step 1005, the calculation of the transient fuel correction value f(AEW) is carried out by the following equation on the basis of Q/N, $(Q/N)_i$, $C_a$, and K; in which $$f(AEW)=\{Q/N-(Q/N)_i\}\times C_a\times K$$

where K is the correction ratio, corresponding to the coolant temperature, for the cooling of the engine and is stored in a map. Note that the value K is about 1.0 to 1.4, and K is large when the coolant temperature THW is low. The value f(AEW) can be either positive or negative, depending on the change of Q/N. The correction is carried out by multiplying the fuel injection amount by the transient fuel correction ratio 1+f(AEW). Then, the routine of FIG. 10 is completed.

As the result of the introduction of the blunting process into the correction calculation, the correction amount for fuel correction further approaches the desired value and, hence, the correction amount is decided more precisely.

Figure 11A:
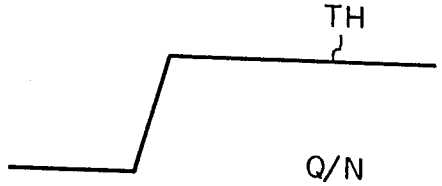
FIGS. 11A through 11E are waveform diagrams explaining the fuel injection state during an acceleration state, according to the present invention.
Figure 11B:
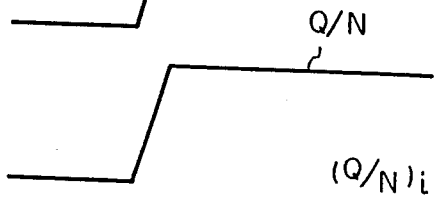
Figure 11C:
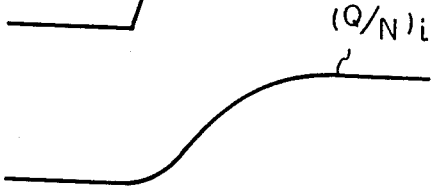
Figure 11D:
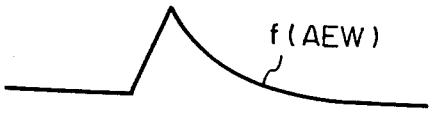
Figure 11E:
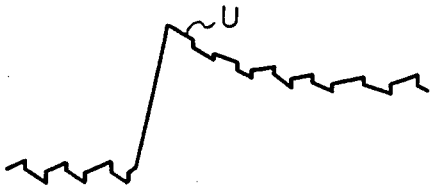

The change with time of the signals in accordance with the above-described transient fuel amount correction operation is illustrated in FIGS. 11A through 11E, and FIGS. 12A through 12E. When acceleration is carried out by increasing the opening degree (TH) of the throttle valve as shown in FIG. 11A, the value Q/N is rapidly increased, however, the blunt value $(Q/N)_i$ is gradually increased as shown in FIGS. 11B and 11C. In this case, the transient fuel correction value f(AEW) is changed as shown in FIG. 11D, so that the fuel injection valve opening period U is decided as shown in FIG. 11E. Thus, the fuel injection is carried out in accordance with the decided fuel injection valve opening period U.

Figure 12A:
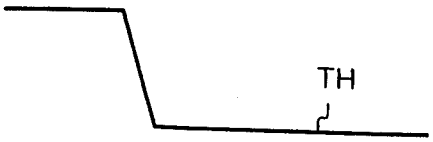
FIGS. 12A through 12E are waveform diagrams explaining the fuel injection state during a deceleration state, according to the present invention.
Figure 12B:
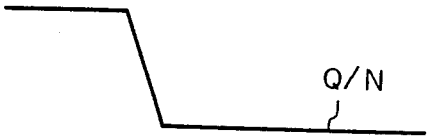
Figure 12C:
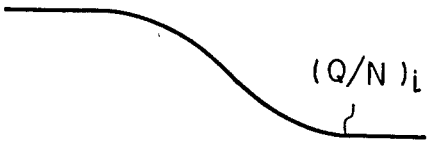
Figure 12D:
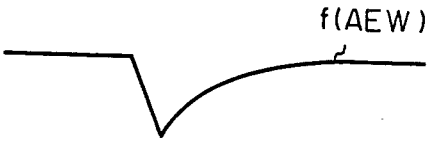
Figure 12E:
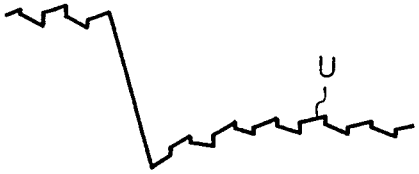

Similarly, when deceleration is carried out by decreasing the opening degree (TH) of the throttle valve as shown in FIG. 12A, the value Q/N is rapidly decreased, and the blunt value $(Q/N)_i$ is gradually decreased as shown in FIGS. 12B and 12C. In this case, the transient fuel correction value f(AEW) is changed as shown in FIG. 12D, and the fuel injection valve opening period U is decided as shown in FIG. 12E. Thus, the fuel injection is carried out in accordance with the decided fuel injection valve opening period U.

Figure 13A:
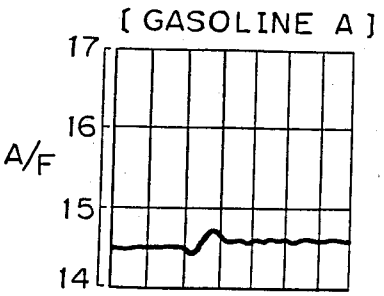
FIGS. 13A and 13B are waveform diagrams of the operation result of the control circuit of FIG. 2.
Figure 13B:
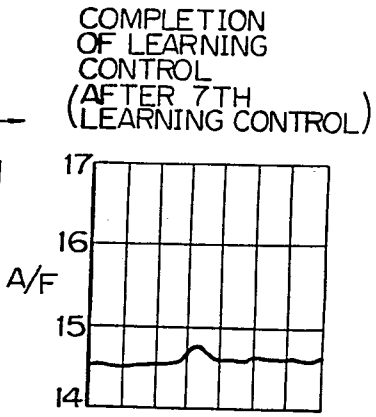
Figure 13B:
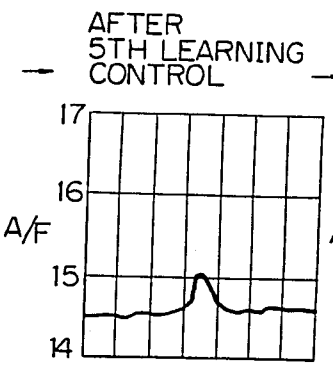
Figure 13B:
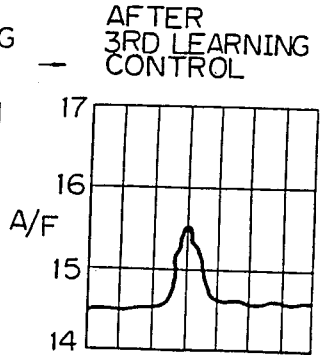
Figure 13B:
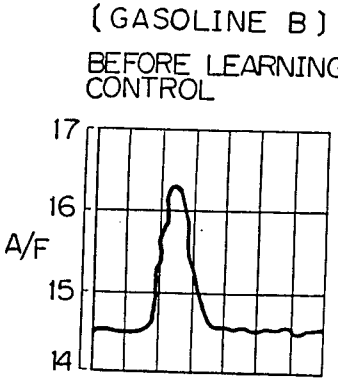

The manner of operation of the apparatus shown in FIG. 2 is shown in FIGS. 13A and 13B. The conditions are selected so that the engine rotational speed is 1000 rpm, and the coolant temperature is 30° C. The acceleration is carried out by the operation of the throttle, and the acceleration is effected quickly from intake air pressure "−400 mmHg" to "−100 mmHg". FIG. 13A represents the change with time of the air-fuel ratio where gasoline A is used. FIG. 13B represents the change with time of the air-fuel ratio where gasoline B is used and learning control is carried out by the apparatus shown in FIG. 2.

As shown in FIGS. 13A and 13B, the optimum air-fuel ratio is almost attained in the acceleration state with the use of gasoline A which has a 10% recovered temperature of 47° C. and a Reid vapor pressure of 0.72 kg/cm$^2$. Where the gasoline B of low volatility, which has a 10% recovered temperature of 54° C. and a Reid vapor pressure of 0.6 kg/cm$^2$, is used, the air-fuel ratio once becomes relatively lean. After that, however, it is possible to attain the same air-fuel ratio characteristic as in the case of the use of gasoline A at the seventh process after execution of the learning processes in the apparatus shown in FIG. 2. This number of learning processes can be reduced by increasing the amount of correction.

Modified or alternative embodiments of the present invention are possible. While the calculations of $(Q/N)_i$ are carried out at a predetermined interval of, for example, 32.7 ms, at steps 901 and 1002 in the above-described embodiment, the calculations can be carried out in synchronization with the rotation of the engine, for example, once per rotation.

The period for detecting the air-fuel ratio deviation is limited to within 5 seconds from the occurrence of acceleration at step 903 in the above-described embodiment. It is also possible, however, to carry out detection by measuring T(LN) in the acceleration state and T(RCH) in the deceleration state.

Further, in the above-mentioned embodiment, it is possible that the intake air pressure and its blunt value, or the throttle opening and its blunt value are used instead of the intake air amount per one engine rotation and its blunt value for calculating the transient correction amount.

Further, a plurality of regions can be also provided for engine operating parameters other than the engine coolant temperature. For example, such a plurality of regions are provided for the intake air amount, the throttle opening, or the engine rotational speed.

We claim:

1. A method for controlling the air-fuel ratio in an internal combustion engine comprising the steps of:

calculating a base fuel amount in accordance with first predetermined engine operating parameters;

determining whether or not said engine is in a transient state;

detecting an air-fuel ratio deviation from the optimum air-fuel ratio for each of a plurality of regions, said regions being defined by predetermined ranges of values of a second engine operating parameter, said detecting only occurring when said engine is in a transient state;

calculating a transient fuel correction amount in accordance with said detected air-fuel ratio deviation for each region as defined by said second engine operating parameter; and calculating a fuel amount to be supplied to said engine by correcting said base fuel amount in accordance with said calculated transient fuel correction amount.

2. A method as set forth in claim 1, wherein said first predetermined engine operating parameters are the intake air amount and the rotational speed of said engine.

3. A method as set forth in claim 1, wherein said first predetermined engine operating parameters are the intake air pressure and the rotational speed of said engine.

4. A method as set forth in claim 1, wherein said transient state determining step comprises the steps of:

determining whether or not the engine coolant temperature is lower than a predetermined value;

determining whether or not a predetermined time period has passed after initiation of acceleration;

determining whether or not the rotational speed of said engine is within a predetermined range; and determining whether or not an air-fuel ratio feedback control operation is carried out, whereby said transient state is established only when all said determinations are affirmative.

5. A method as set forth in claim 1, wherein said air-fuel ratio deviation detecting step comprises the steps of:

calculating a lean state duration for each region determined by said second predetermined engine operating parameter; and calculating a rich state duration for each region determined by said second predetermined engine parameter.

6. A method as set forth in claim 1, wherein said second engine operating parameter is the engine coolant temperature.

7. A method as set forth in claim 1, wherein said second engine operating parameter is the intake air amount of said engine.

8. A method as set forth in claim 1, wherein said second engine operating parameter is the throttle opening of said engine.

9. A method as set forth in claim 1, wherein said second engine operating parameter is the rotational speed of said engine.

10. A method as set forth in claim 5, wherein said transient fuel correction amount calculating step calculates the transient fuel correction ratio 1+f(AEW) by $$1+f(AEW) \leftarrow 1+\{Q/N-(Q/N)_i\}\times C_a\times K$$

where

Q is the intake air amount of said engine;

N is the rotational speed of said engine;

$(Q/N)_i$ is a blunt value of Q/N;

$C_a$ is a coefficient determined by said maximum lean state duration and maximum rich state duration; and K is a coefficient determined by the coolant temperature of said engine.

11. A method as set forth in claim 10, wherein said blunt value $(Q/N)_i$ is calculated by $$(Q/N)_i \leftarrow (Q/N)_{i-1}+\{Q/N-(Q/N)_{i-1}\}/C_b$$

where $(Q/N)_{i-1}$ is a blunt value of Q/N calculated at a previous cycle; and $C_b$ is a coefficient determined by said lean state duration and rich state duration.

12. A method as set forth in claim 5, wherein said transient fuel correction amount calculating step calculates the transient fuel correction ratio 1+f(AEW) by $$1+f(AEW) \leftarrow 1+\{PM-(PM)_i\}\times C_a\times K$$

where

PM is the intake air pressure of said engine;

N is the rotational speed of said engine;

$(PM)_i$ is a blunt value of PM;

$C_a$ is a coefficient determined by said lean state duration and rich state duration; and K is a coefficient determined by the engine coolant temperature.

13. A method as set forth in claim 12, wherein said blunt value $(PM)_i$ is calculated by $$(PM)_i \leftarrow (PM)_{i-1}+\{PM-(PM)_{i-1}\}/C_b$$

where $(PM)_{i-1}$ is a blunt value of PM calculated at a previous cycle; and $C_b$ is a coefficient determined by said lean state duration and rich state duration.

14. A method as set forth in claim 5, wherein said transient fuel correction amount calculating step calculates the transient fuel correction ratio 1+f(AEW) by $$1+f(AEW) \leftarrow 1+\{TH-(TH)_i\}\times C_a\times K$$

where

TH is the throttle opening of said engine;

N is the rotational speed of said engine;

$(TH)_i$ is a blunt value of TH;

$C_a$ is a coefficient determined by said lean state duration and rich state duration; and K is a coefficient determined by the engine coolant temperature.

15. A method as set forth in claim 14, wherein said blunt value $(TH)_i$ is calculated by $$(TH)_i \leftarrow (TH)_{i-1}+\{TH-(TH)_{i-1}\}/C_b$$

where $(TH)_{i-1}$ is a blunt value of TH calculated at a previous cycle; and $C_b$ is a coefficient determined by said maximum lean state duration and maximum rich state duration.

16. An apparatus for controlling the air-fuel ratio in an internal combustion engine comprising:

means for determining whether or not said engine is in a transient state;

means for detecting an air-fuel ratio deviation from the optimum air-fuel ratio for each of a plurality of regions, said regions being defined by predetermined ranges of values of a second engine operating parameter, said detecting occurring only when said engine is in a transient state; and processing means, responsive to said determining means and said detecting means for performing the functions of: (a) calculating a base fuel amount in accordance with first predetermined engine operating parameters, (b) calculating a transient fuel correction amount in accordance with said detected air-fuel ratio deviation for each region as defined by said second engine operating parameter, and (c) calculating a fuel amount to be supplied to said engine by correcting said base fuel amount in accordance with said calculated transient fuel correction amount.

17. An apparatus as set forth in claim 16, wherein said processing means calculates said base fuel amount in accordance with the intake air amount and the rotational speed of said engine.

18. An apparatus as set forth in claim 16, wherein said processing means calculates said base fuel amount in accordance with the intake air pressure and the rotational speed of said engine.

19. An apparatus as set forth in claim 16, wherein:

said transient state determining means comprises means for determining engine coolant temperature; and said processing means is also for: (d) determining whether or not the engine coolant temperature is lower than a predetermined value, (e) determining whether or not a predetermined time period has passed since the initiation of acceleration, (f) determining whether or not the rotational speed of said engine is within a predetermined range, and (g) determining whether or not an air-fuel ratio feedback control operation is carried out, whereby said transient state is established only when all said determinations are affirmative.

20. An apparatus as set forth in claim 16, wherein:

said air-fuel ratio deviation detecting means comprises means for monitoring exhaust gases to determine when the engine is operating in lean and rich states; and said processing means is also for: (d) calculating a lean state duration for each region determined by said second predetermined engine operating parameter and (e) calculating a rich state duration for each region determined by said second predetermined engine parameter.

21. An apparatus as set forth in claim 16, wherein said detecting means includes means for detecting engine coolant temperature, said second engine operating parameter being the engine coolant temperature.

22. An apparatus as set forth in claim 16, wherein said detecting means includes means for detecting intake air amount of the engine, said second engine operating parameter being the intake air amount of said engine.

23. An apparatus as set forth in claim 16, wherein said detecting means includes means for detecting throttle opening of said engine, said second engine operating parameter being the throttle opening of said engine.

24. An apparatus as set forth in claim 16, wherein said detecting means includes means for detecting the rotational speed of said engine, said second engine operating parameter being the rotational speed of said engine.

25. An apparatus as set forth in claim 20, wherein said processing means, when performing said function (b), calculates the transient fuel correction ratio 1+f(AEW) by $$1+f(AEW)\leftarrow 1+\{Q/N-(Q/N)_i\}\times C_a\times K$$

where

Q is the intake air amount of said engine;

N is the rotational speed of said engine;

$(Q/N)_i$ is a blunt value of Q/N;

$C_a$ is a coefficient determined by said lean state duration and rich state duration; and K is a coefficient determined by the coolant temperature of said engine.

26. An apparatus as set forth in claim 25, wherein said processing means also calculates said blunt value $(Q/N)_i$ by $$(Q/N)_i\leftarrow (Q/N)_{i-1}+\{Q/N-(Q/N)_{i-1}\}/C_b$$

where $(Q/N)_{i-1}$ is a blunt value of Q/N calculated at a previous cycle; and $C_b$ is a coefficient determined by said lean state duration and rich state duration.

27. An apparatus as set forth in claim 20, wherein said processing means, when performing said function (b), calculates the transient fuel correction ratio 1+f(AEW) by $$1+f(AEW)\leftarrow 1+\{PM-(PM)_i\}\times C_a\times K$$

where

PM is the intake air pressure of said engine;

N is the rotational speed of said engine;

$(PM)_i$ is a blunt value of PM;

$C_a$ is a coefficient determined by said lean state duration and rich state duration; and K is a coefficient determined by the engine coolant temperature.

28. An apparatus as set forth in claim 27, wherein said processing means also calculates said blunt value $(PM)_i$ by $$(PM)_i\leftarrow (PM)_{i-1}+\{PM-(PM)_{i-1}\}/C_b$$

where $(PM)_{i-1}$ is a blunt value of PM calculated at a previous cycle; and $C_b$ is a coefficient determined by said lean state duration and rich state duration.

29. An apparatus as set forth in claim 20, wherein said processing means, when performing said function (b), calculates the transient fuel correction ratio 1+f(AEW) by $$1+f(AEW)\leftarrow 1+\{TH-(TH)_i\}\times C_a\times K$$

where

TH is the intake air amount of said engine;

N is the rotational speed of said engine;

$(TH)_i$ is a blunt value of TH;

$C_a$ is a coefficient determined by said maximum lean state duration and maximum rich state duration; and K is a coefficient determined by the engine coolant temperature.

30. An apparatus as set forth in claim 29, wherein said processing means calculates said blunt value $(TH)_i$ by $$(TH)_i\leftarrow (TH)_{i-1}+\{TH-(TH)_{i-1}\}/C_b$$

where $(TH)_{i-1}$ is a blunt value of TH calculated at a previous cycle; and $C_b$ is a coefficient determined by said lean state duration and rich state duration.

31. A method as set forth in claim 1, wherein said air-fuel ratio deviation detecting step comprises the step of detecting a rich or lean state duration for each said region determined by said second predetermined engine operating parameter, thereby detecting a corresponding one of said air-fuel ratio deviations in accordance with the calculated rich or lean state determination.

* * * * *